US009535385B2

(12) United States Patent
Ritzer et al.

(10) Patent No.: US 9,535,385 B2
(45) Date of Patent: Jan. 3, 2017

(54) METHOD TO ADJUST THE PRINT QUALITY OF PRINT IMAGES IN AN ELECTROPHORETIC DIGITAL PRINTER

(71) Applicant: Oce Printing Systems GmbH & Co. KG, Poing (DE)

(72) Inventors: Alfons Ritzer, Dorfen (DE); Andreas Paul, Vaterstetten (DE); Georg Landmesser, Haar (DE); Matthias Fromm, Markt Schwaben (DE); Thomas Montag, Unterhachnig (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/015,367

(22) Filed: Feb. 4, 2016

(65) Prior Publication Data

US 2016/0231682 A1 Aug. 11, 2016

(30) Foreign Application Priority Data

Feb. 10, 2015 (DE) ..... 10 2015 101 851

(51) Int. Cl.

*G03G 15/00* (2006.01)
*G03G 15/10* (2006.01)
*G03G 13/10* (2006.01)

(52) U.S. Cl.

CPC ..... *G03G 15/50* (2013.01); *G03G 13/10* (2013.01); *G03G 15/105* (2013.01); *G03G 15/5041* (2013.01)

(58) Field of Classification Search

CPC ..... G03G 15/10; G03G 15/105; G03G 15/11; G03G 15/50; G03G 13/10

USPC ..... 399/57–60

See application file for complete search history.

(56) References Cited

U.S. PATENT DOCUMENTS

| | | | |
|---|---|---|---|
| 5,369,476 | A | 11/1994 | Bowers et al. |
| 6,895,200 | B2 | 5/2005 | Tagansky |
| 7,292,810 | B2 | 11/2007 | Tanner et al. |
| 7,522,865 | B2 | 4/2009 | Hasdai et al. |

(Continued)

FOREIGN PATENT DOCUMENTS

| | | | |
|---|---|---|---|
| DE | 4302381 | A1 | 8/1993 |
| DE | 102008048256 | A1 | 4/2010 |

(Continued)

*Primary Examiner* — Walter Lindsay, Jr.
*Assistant Examiner* — Jessica L Eley
(74) *Attorney, Agent, or Firm* — Schiff Hardin LLP

(57) ABSTRACT

In a method to adjust print quality of print images in an electrophoretic digital printer with at least one print group, the print group generates charge images of the print images. The charge images are developed with a developer station into toner images using liquid developer having carrier fluid and toner. The toner images are transfer-printed onto a carrier medium in a transfer station. A first control marking is generated on the recording medium with elements of the first control marking being aligned transverse to a printing direction. A shape of the elements of the first control marking is measured to generate a first measurement signal. The first measurement signal is compared with a predetermined nominal value, and given a difference, an adjustment signal is generated via which an amount of the carrier fluid in the liquid developer is modified so that the first measurement signal approaches the predetermined nominal value.

20 Claims, 8 Drawing Sheets

(56) References Cited

U.S. PATENT DOCUMENTS

| | | | | |
|---|---|---|---|---|
| 8,509,656 | B2 | 8/2013 | Kopp | |
| 2002/0159794 | A1 | 10/2002 | Nakashima et al. | |
| 2012/0237264 | A1* | 9/2012 | Hirayama | G03G 15/10 399/237 |
| 2013/0308984 | A1 | 1/2013 | Sandler et al. | |
| 2013/0272734 | A1* | 10/2013 | Zollner | G03G 15/0824 399/57 |
| 2013/0272749 | A1* | 10/2013 | Montag | G03G 15/104 399/251 |
| 2015/0078773 | A1* | 3/2015 | Maeyama | G03G 15/5041 399/49 |

FOREIGN PATENT DOCUMENTS

| | | | |
|---|---|---|---|
| DE | 102009060334 | A1 | 6/2011 |
| DE | 102010015985 | A1 | 9/2011 |
| EP | 1074891 | B1 | 2/2001 |
| WO | 2006090352 | A1 | 8/2006 |

* cited by examiner

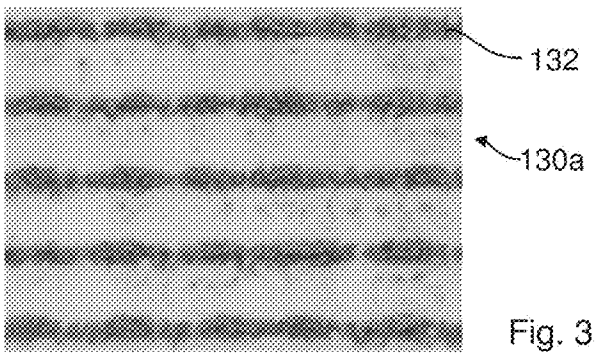
Fig. 3
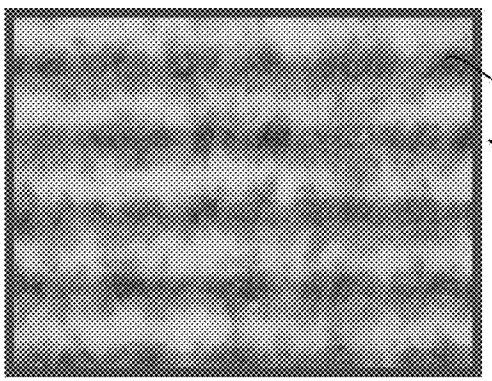
Fig. 4
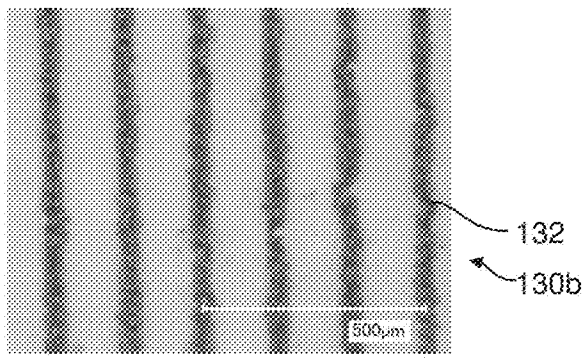
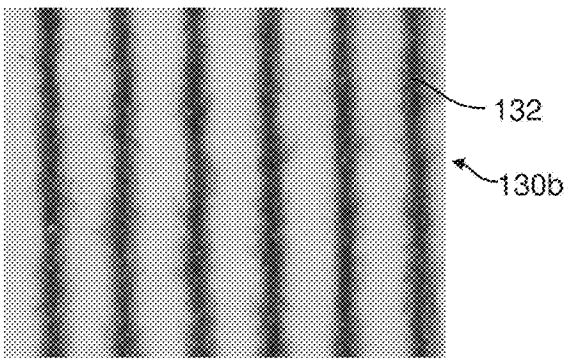
Printing direction ⟶ PF

METHOD TO ADJUST THE PRINT QUALITY OF PRINT IMAGES IN AN ELECTROPHORETIC DIGITAL PRINTER

BACKGROUND

The disclosure concerns a digital printer with at least one print group to print to a recording medium with toner particles that are applied with the aid of a liquid developer, in particular a high-capacity printer to print to web-shaped or sheet-shaped recording media.

In such digital printers, a latent charge image of a charge image carrier is inked by a print group by means of electrophoresis, with the aid of a liquid developer. The toner image that is created in such a manner is transferred to the recording medium indirectly via a transfer element or directly. The liquid developer has toner particles and carrier fluid in a desired ratio. Mineral oil is preferably used as a carrier fluid. In order to provide the toner particles with an electrostatic charge, charge control substances are added to the liquid developer. Further additives are additionally added, for example in order to achieve the desired viscosity or a desired drying behavior of the liquid developer.

Such digital printers have long been known already, for example from DE 10 2010 015 985 A1, DE 10 2008 048 256 A1 or DE 10 2009 060 334 A1.

To ink the charge images on the charge image carrier, liquid developer is directed by a developer station past the charge image carrier. The developer station has in a known manner: a developer roller that directs the liquid developer past the charge image carrier; an application system that supplies the liquid developer to the developer roller; and a cleaning unit that cleans off the residual liquid developer that remains on the developer roller after the inking of the charge images on the charge image carrier.

Developer stations in which liquid developer is supplied to a charge image carrier are known. In U.S. Pat. Nos. 7,522,865 B2, 7,292,810 B2, 6 895 200 B2, developer stations are described in which liquid developer is directed past a developer roller. Arranged adjacent to the developer roller is an electrode between which and the developer roller the liquid developer is directed through. An electrical voltage exists between the electrode and the developer roller, due to which electrical voltage the toner is drawn to the developer roller. Before the liquid developer is supplied to the charge image carrier, it travels through a gap (nip) that exists between a dosing means (for example a blade or a dosing roller) and the developer roller. The dosing means is at such an electrical potential that the toner migrates to the developer roller; and at the same time, the thickness of the liquid developer layer on the developer roller is established. Examples of dosing means are described in WO 2006/090352 A1 and U.S. 2002/0159794 A1.

The developer layer on the developer roller may thus be adjusted by means of the dosing roller in terms of its properties, for example the layer thickness, toner concentration. The two significant influencing variables are thereby the potential difference between the developer roller and the dosing roller and the contact pressure force between the dosing roller and the developer roller or the nip length that results from this. These determine the conveying capacity in the nip, and therefore the toner concentration of the developer layer. It is typical that the two rollers are coupled via a gearing, and that the surfaces of the rollers run synchronously on one another. However, the possibility also exists to affect the composition of the developer layer via a variation of the velocity of the dosing roller given constant velocity of the developer roller.

In order to generate a print image of high quality, it is necessary that the amount of carrier fluid in the liquid developer (in particular the amount of carrier fluid on the recording medium) does not vary unacceptably. Quantities of carrier fluid that are too great upon the transfer of toner image to the recording medium lead to the situation that the print image diverges at the recording medium, and the structures of the print image appear to be blurry and washed-out. It additionally leads to increased costs due to increased consumption of carrier fluid and to a degraded and/or more expensive fixing. The transfer of carrier fluid back into the transfer station may also be negatively affected. Too low a quantity of carrier fluid upon transfer of the toner image to the recording medium has the effect of a poor transfer efficiency of the toner upon transfer printing of the toner image onto the recording medium. Too high a viscosity of the liquid developer may limit the mobility of the toner, and may additionally lead to severe local differences in the transfer efficiency. It is thereby to be considered that the optical quantity of carrier fluid in the transfer of the toner images is also dependent on the material of the recording medium and—given multicolor printing with multiple print group—changes from print group to print group.

SUMMARY

It is an object to specify a method in which the amount of carrier fluid in the liquid developer may be adjusted so that the transfer of toner images onto the recording medium, and the deposition of the toner on the recording medium, take place under optimal conditions.

In a method to adjust print quality of print images in an electrophoretic digital printer with at least one print group, the print group generates charge images of the print images. The charge images are developed with a developer station into toner images using liquid developer having carrier fluid and toner. The toner images are transfer-printed onto a carrier medium in a transfer station. A first control marking is generated on the recording medium with elements of the first control marking being aligned transverse to a printing direction. A shape of the elements of the first control marking is measured to generate a first measurement signal. The first measurement signal is compared with a predetermined nominal value, and given a difference, an adjustment signal is generated via which an amount of the carrier fluid in the liquid developer is modified so that the first measurement signal approaches the predetermined nominal value.

BRIEF DESCRIPTION OF THE DRAWINGS

FIGS. 3 and 4 are examples of control markings with horizontally and vertically aligned lines given the use of different amounts of carrier fluid in transfer printing;

DESCRIPTION OF EXEMPLARY EMBODIMENTS

Figure 1:
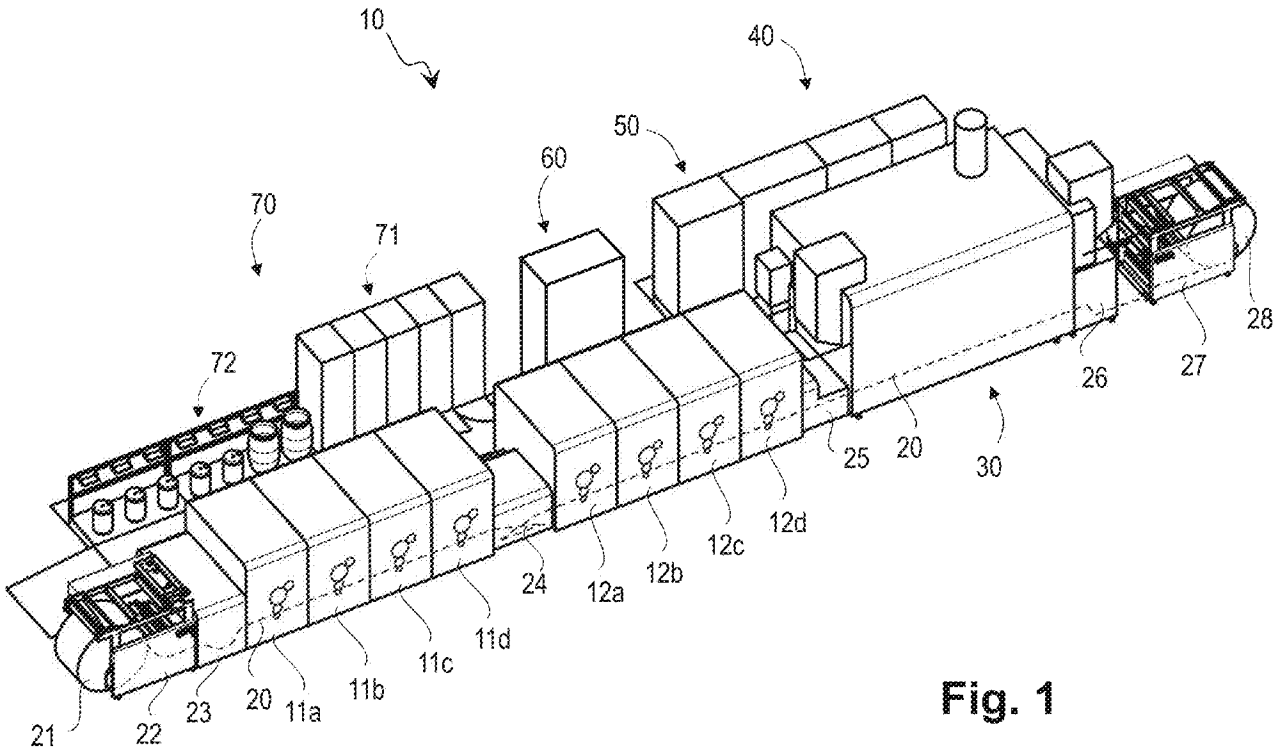
FIG. 1 is a view of a digital printer given an example of a configuration of the digital printing.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the invention relates are included herein.

With the aid of control markings printed on the recording medium, it is established whether the carrier fluid has a predetermined amount upon transfer of the toner images onto the recording medium, given which predetermined amount the transfer of the toner images into the recording medium, and the print image on the recording medium, achieve the desired quality. The structures of the control markings are chosen so that the one control marking reacts extremely sensitively to the amount of carrier fluid; in contrast to this, the other control marking remains essentially unaffected. The control markings are, for example, realized such that a smearing of the toner in different directions occurs with different severity relative to the printing direction. A first control marking should have elements around it that have edges preferably traveling transverse to the printing direction. A second control marking used for reference building should then have elements that are aligned substantially in the printing direction. The elements may be lines or grids with different alignment. For example, a marking with lines aligned transverse to the printing direction of the recording medium may thereby be used as a first control marking, and a marking with lines situated in the printing direction of the recording medium may be used as a second control marking. Given an increasing amount of carrier fluid in the transfer of the toner images onto the recording medium, the printed lines of the first control marking are shown broader than those of the second control marking. This leads to a change of the structure of the first control marking, for example to a greater and non-uniform inking of the lines of the first control marking on the recording medium, in particular given print images arranged in a grid. It is therefore an object to keep the amount of carrier fluid within an optimal range upon printing using the control markings.

The method according to the exemplary embodiment thus has the following advantages:

- For testing, an indirect measurement method is used in order to establish whether the carrier fluid amount that is used is within the predetermined range in each print group.
- The evaluation of the control markings is possible in the printing operation; and no interruption of printing is necessary for this.
- A continuous measurement data acquisition and a simultaneous evaluation in all print groups enables a targeted regulation of the carrier fluid amount during printing.

A combination with a raster/color regulation and detail quality regulation is possible that may use the same control markings and requires no additional sensor for this.

- Different amounts of carrier fluid in the liquid developer can be adjusted individually for each print group, and therefore the toner concentration and the flow properties of the liquid developer are also adjusted.

Exemplary embodiments of the invention are explained in detail in the following using the schematic drawings.

According to FIG. 1, a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium 20 as a recording medium 20 is unspooled from a roll 21 with the aid of a take-off 22 and is supplied to the first print group 11*a*. The print image 20' is fixed on the recording medium 20 in a fixer 30. The recording medium 20 may subsequently be taken up on a roll 28 with the aid of a take-up 27. Such a configuration is also designated as a roll-to-roll printer.

In the configuration shown in FIG. 1, the web-shaped recording medium 20 is printed to in full color on the front side with (for example) four print groups 11*a* through 11*d* and on the back side with (for example) four print groups 12*a* through 12*d*. For this, the recording medium 20 is unwound from the roll 21 by the take-off 22 and is supplied to the first print group 11*a* via an optional conditioning group 23. In the conditioning group 23 the recording medium 20 may be pre-treated or coated with a suitable substance. Wax or a chemically equivalent substance may be used as a coating substance.

The recording medium 20 is subsequently supplied first, in order, to the first print groups 11*a* through 11*d* in which only the front side is printed to. Each print group 11*a*-11*d* typically prints to the recording medium 20 in a different color, or also with a different toner material (for example MICR toner which can be read electromagnetically).

After printing to the front side, the recording medium 20 may be turned in a turner 24 and is supplied to the remaining print groups 12*a*-12*d* for printing to the back side.

In order to achieve a full-color printing, at least four colors (and therefore at least four print groups 11, 12) are required, and in fact the primary colors YMCK (Yellow, Magenta, Cyan and Black), for example. Still more print groups 11, 12 with special colors (for example customer-specific colors or additional primary colors in order to expand the printable color space) may also be used.

Arranged after the print group 12*d* is a register 25 via which registration marks—which are printed on the recording medium 20 independently of the print image 20' (in particular outside of the print image 20')—are evaluated. The transverse and longitudinal registration (the primary color dots that form a color point should be arranged atop one another or spatially very close to one another; this is also designated as color registration or four-color registration) and the register (front side and back side must spatially coincide precisely) can therefore be adjusted so that a qualitatively good print image 20' is achieved.

Arranged after the register 25 is the fixer 30 via which the print image 20' is fixed on the recording medium 20.

Arranged after the fixer 30 is a puller 26 that pulls the recording medium 20 through all print groups 11*a*-12*d* and the fixer 30 without an additional drive being arranged in this region. The puller 26 feeds the recording medium 20 to the take-up 27, which rolls up the printed recording medium 20.

Centrally arranged in the print groups 11, 12 and the fixer 30 are all supply devices for the digital printer 10, such as air-conditioner 40, power supply 50, controller 60, fluid management 70 (such as fluid control 71 and reservoirs 72 of the different fluids). In particular, pure carrier fluid, highly-concentrated liquid developer (high proportion of toner particles in relation to carrier fluid) and serum (liquid developer plus charge control substances) are required as fluids in order to supply the digital printer 10, as well as waste containers for fluids to be disposed of or containers for cleaning fluid.

The digital printer 10, with its structurally identical print groups 11, 12, is of modular design. The print groups 11, 12 do not differ mechanically, but rather only due to the liquid developer (toner color or toner type) used therein.

Figure 2:
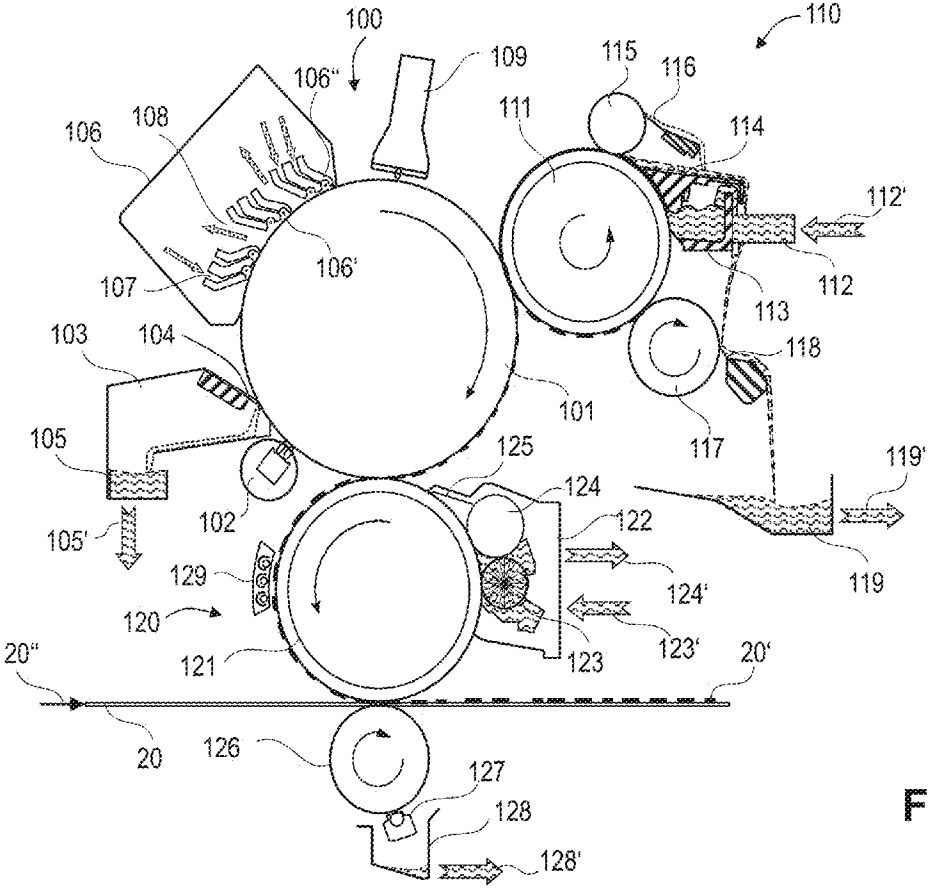
FIG. 2 is a schematic design of a print group of the digital printer according to FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a manner is transferred to the recording medium 20.

The print group 11, 12 is essentially comprised of an electrophotography station 100, a developer station 110 and a transfer station 120.

a) Design of the Electrophotography Station 100:

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in the arrow direction).

The photoconductor is initially cleaned of all contaminants. For this, an erasure light 102 is present that erases charges that still remain on the surface of the photoconductor. The erasure light 102 can be calibrated (is locally adjustable) in order to achieve a homogeneous light distribution. The surface may therefore be pre-treated uniformly. After the erasure light 102, a cleaner 103 mechanically cleans off the photoconductor in order to remove toner particles that are possibly still present on the surface of the photoconductor, possible dirt particles and remaining carrier fluid. The cleaned-off carrier fluid is supplied to a collection container 105. The collected carrier fluid and toner particles are prepared (filtered as necessary) and fed—depending on color—to a corresponding liquid color reservoir, i.e. to one of the storage containers 72 (see arrow 105').

The cleaner 103 preferably has a blade 104 that rests on the surface shell of the photoconductor roller 101 at an acute angle (approximately 10° to 80° relative to the outflow surface) in order to mechanically clean off the surface. The blade 104 may move back and forth, transversal to the rotation direction of the photoconductor roller 101, in order to optimally clean the surface shell along the entire axial length with as little wear as possible.

The photoconductor is subsequently charged by a charging device 106 to a predetermined electrostatic potential. For this, multiple corotrons (in particular glass shell corotrons) are preferably present. The corotrons are comprised of at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for aeration and exhaust channel 108 for ventilation) between the shields (see also the air flow arrows in FIG. 2). The supplied air is then uniformly ionized at the wire 106'. A homogeneous, uniform charging of the adjacent surface of the photoconductor is thereby achieved. The uniform charging is further improved with dry and heated air. Air is discharged via the exhaust channels 108. Ozone that is possibly created may likewise be drawn away via the exhaust channels 108.

The corotrons can be cascaded, meaning that then two or more wires 106' are present per shield 106" given the same shielding voltage. The current that flows across the shield 106" is adjustable, and the charge of the photoconductor is thereby controllable. The corotrons may be fed with currents of different strengths in order to achieve a uniform and sufficiently high charge at the photoconductor.

Arranged after the charger 106 is a character generator 109 that, via optical radiation, discharges the photoconductor per pixel depending on the desired print image 20'. A latent image is thereby created that is later inked with toner particles (the inked image corresponds to the print image 20'). An LED character generator 109 is preferably used, in which an LED line with many individual LEDs is arranged stationary over the entire axial length of the photoconductor roller 101. The number of LEDs and the size of the optical mapping points on the photoconductor 101 determine (among other things) the resolution of the print image 20' (typical resolution is 600 dpi×600 dpi.

b) Design of the Developer Station 110:

The latent image generated by the character generator 109 is inked with toner particles by the developer station 110. The developer station 110 has for this a rotating developer roller 111 that directs a layer of liquid developer towards the photoconductor. Since the surface of the photoconductor roller 101 is relatively hard, the surface of the developer roller 111 is relatively soft, and if the two are pressed against one another a thin, high nip (a gap between the rollers) is created in which the charged toner particles migrate electrophoretically from the developer roller 111 onto the photoconductor at the image points, due to an electrical field. No toner transfers to the photoconductor at the non-image points. The nip filled with liquid developer has a height (width of the gap) that is dependent on the mutual pressure of the two rollers 101, 111 and the viscosity of the liquid developer.

The developer station 110 thus inks the latent print image 20' with a predetermined toner. For this, the developer roller 111 supplies toner particles to the photoconductor. In order to ink the developer roller 111 itself with a layer over its entire surface, liquid developer is initially supplied at a predetermined concentration from a mixing container (not shown; within the fluid control 71) via a fluid feed 112' to a reservoir chamber 112. From this reservoir chamber 112, the liquid developer is supplied in abundance to a pre-chamber 113 (a type of pan that is open at the top). An electrode segment 114 is arranged towards the developer roller 111, which electrode segment 114 forms a gap between itself and said developer roller 111.

The developer roller 111 rotates through the pre-chamber 113 that is open at the top and thereby carries liquid developer along in the gap. Excess liquid developer flows out from the pre-chamber 113 back to the reservoir chamber 112.

Due to the electrical field (formed by the electrical potentials) between the electrode segment 114 and the developer roller 111, the liquid developer in the gap is divided up into two regions, and in fact into: a layer region in proximity to the developer roller 111, in which layer region the toner particles concentrate (concentrated liquid developer); and a second region in proximity to the electrode segment 114, which is low in toner particles (very low-concentration liquid developer).

The layer of the liquid developer is subsequently transported further to a dosing roller 115. The dosing roller 115 squeezes out the upper layer of the liquid developer so that afterward a defined layer thickness of liquid developer—of approximately 5 μm thickness—remains on the developer roller 111. Since the toner particles are essentially located near the surface of the developer roller 111, in the carrier fluid, the outwardly situated carrier fluid is essentially squeezed out or retained and ultimately is returned back to a collection container 119, but not to the reservoir chamber 112.

As a result of this, it is predominantly highly concentrated liquid developer that is conveyed through the nip between dosing roller 115 and developer roller 111. A uniformly thick layer of liquid developer is thus created, with approximately 40 percent by mass toner particles and approximately 60 percent by mass carrier fluid after the dosing roller 115 (the mass ratios may also fluctuate more or less depending on the printing process requirements). This uniform layer of liquid developer is transported in the nip between the developer roller 111 and the photoconductor roller 101. There the image points of the latent image are then electrophoretically inked with toner particles, while no toner transfers to the photoconductor in the area of non-image points. Sufficient carrier fluid is absolutely necessary for electrophoresis. The fluid film divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 may again be coated with liquid developer under the same conditions and uniformly, remaining toner particles (these essentially represent the negative, untransferred print image) and liquid developer are electrostatically and mechanically removed by a cleaning roller 117. The cleaning roller 117 itself is cleaned by a blade 118. The cleaned-off liquid developer is supplied to the collection container 119 for reuse, to which collection container 119 the liquid developer cleaned off from the dosing roller 115 (by means of a blade 116, for example) and the liquid developer cleaned off from the photoconductor roller 101 (by means of the blade 104) are also supplied. The liquid developer collected in the collection container 119 is supplied to the mixing container via the fluid discharge 119'.

c) Design of the Transfer Station 120:

The inked image rotates with the photoconductor roller 111 up to a first transfer point at which the inked image is essentially completely transferred to a transfer roller 121. At the first transfer point (nip between photoconductor roller 101 and transfer roller 121), the transfer roller 121 moves in the same direction as the photoconductor 101 and preferably at an identical speed. After the transfer of the print image 20' to the transfer roller 121, the print image 20' (toner particles) may optionally be recharged or charged by means of a charge unit 129 (a corotron, for example) in order to be able to subsequently better transfer the toner particles to the recording medium 20.

The recording medium 20 travels through between the transfer roller 121 and a counter-pressure roller 126, in the transport direction 20". The contact region (nip) represents a second transfer point at which the toner image is transferred to the recording medium 20. In the second transfer region, the transfer roller 121 moves in the same direction as the recording medium 20. The counter-pressure roller 126 also rotates in this direction in the region of the nip. The velocities of the transfer roller 121, the counter-pressure roller 126 and the recording medium 20 are matched to one another at the transfer point and are preferably identical so that the print image 20' is not smeared. At the second transfer point, the print image 20' may be electrophoretically transferred onto the recording medium 20 due to an electrical field between the transfer roller 121 and the counter-pressure roller 126. Moreover, the counter-pressure roller 126 typically presses against the relatively soft transfer roller 121 with a large mechanical force, whereby the toner particles may also remain stuck to the recording medium 20 due to the adhesion.

The print image 20' should in fact transfer completely to the recording medium 20; nevertheless, a few toner particles may undesirably remain on the transfer roller 121. A portion of the carrier fluid always remains on the transfer roller 121 as a result of the wetting. The toner particles that are possibly still present should be nearly completely removed by a cleaner 122 following the second transfer point. The carrier fluid still located on the transfer roller 121 may also be completely removed from the transfer roller 121—or be removed up to a predetermined layer thickness—so that, after the cleaner 122 and before the first transfer point from the photoconductor roller 101 to the transfer roller 121, the same conditions prevail due to a clean surface or a defined layer thickness with liquid developer on the surface of the transfer roller 121.

This cleaner unit 122 is preferably designed as a wet chamber with a cleaning brush 123 and a cleaning roller 124. In the region of the brush 123, cleaning fluid (for example, carrier fluid or a separate cleaning fluid may be used) is supplied via a cleaning fluid feed 123'. The cleaning brush 123 rotates in the cleaning fluid and thereby "brushes" the surface of the transfer roller 121. The toner adhering to the surface is thereby loosened. A conditioning element 125 is arranged at the outflow from the wet chamber. As shown, a retention plate that is arranged at an obtuse angle (for instance between 100° and 175° between plate and outflow surface) relative to the transfer roller 121 may be used as a conditioner 125, whereby residues of fluid on the surface of the roller are nearly completely kept back in the wet chamber and supplied to the cleaning roller 124 for removal via a cleaning fluid discharge 124' to a cleaning fluid reservoir (at the reservoirs 72) (not shown).

The counter-pressure roller 126 is likewise cleaned by a cleaner unit 127. A blade, a brush and/or a roller as a cleaner may remove contaminants (paper dust, toner particle residues, liquid developer etc.) from the counter-pressure roller 126. The cleaned fluid is collected in a collection container 128 and provided again to the printing process (possibly after cleaning) via a fluid discharge 128'.

d) Regulation of the Amount of Carrier Fluid Upon Transfer of the Toner Images to the Recording Medium 20

The quality of the print images on the recording medium 20 depends in particular on what amount of carrier fluid is present upon transfer of the toner images to said recording medium 20. If this amount is too small, the transfer of the toner images to the recording medium 20 is inadequate; if too much carrier fluid is present in the transfer region, too much carrier fluid arrives at the recording medium 20, and the toner images bleed on the recording medium 20. A goal of the exemplary embodiment is therefore to adjust the amount of carrier fluid in the transfer region and on the recording medium 20 so that the toner images transfer-printed onto the recording medium 20 exhibit a high quality. For this, it should be possible to control the amount of carrier fluid in the transfer process. However, it is then advantageous if the amount of carrier fluid in this region may be determined, and that this could then be regulated to a predetermined nominal value.

Control markings 130 (see FIG. 3 through 8) printed on the recording medium 20 may be used for this measure if their structures are designed so that they allow the amount of carrier fluid used in the generation of the toner images on the recording medium 20 to be detected. For example, the control markings are realized such that upon printing a smearing of the toner in the print image occurs with different severity in different directions. A first control marking **130*a* should have elements with edges preferably running transverse to the printing direction PF. A second control marking 130***b* used for reference building should then have elements that are aligned essentially in the printing direction PF. These control markings 130 could, for example, be measured via a measurement unit 13 (134 in FIG. 9) arranged in the register 25 (FIG. 1).

Line patterns printed on the recording medium 20 may be used as control markings, for example, since their lines have a different shape depending on the amount of carrier fluid. It is advantageous to print two control markings 130*a*, 130*b*, comprised of a predetermined line pattern of identical nominal coverage transversal to the printing direction PF (first control marking 130*a* in FIG. 3 through 8) and in the printing direction PF (second control marking 130*b* in FIG. 3 through 8), one after another on the recording medium 20. These control markings 130*a*, 130*b* may then be measured by the measurer 134 (FIG. 9), wherein first and second measurement signals 131*a*, 131*b* are generated depending on the structures of the control markings 130*a*, 130*b*, for example the shapes of their lines and therefore the shape of the control markings 130*a*, 130*b*. An adjustment signal 136 for the regulation of the carrier fluid amount may be derived from this. Measurement signals 131*a*, 131*b* may be derived from the structures of the control markings 130*a*, 131*b*, for example with the aid of an image processing method. Or, inking signals from the inking of the control markings 130*a*, 130*b* may be determined as measurement signals 131*a*, 131*b*, and the adjustment signal 136 may be derived depending on these. In the following explanation of the invention, a method is described for determining the inking of the control markings 130*a*, 130*b* to derive the adjustment signal 136, without that the exemplary embodiment should be limited to this example of the gauging of the structures of the control markings 130*a*, 130*b*.

Figure 9:
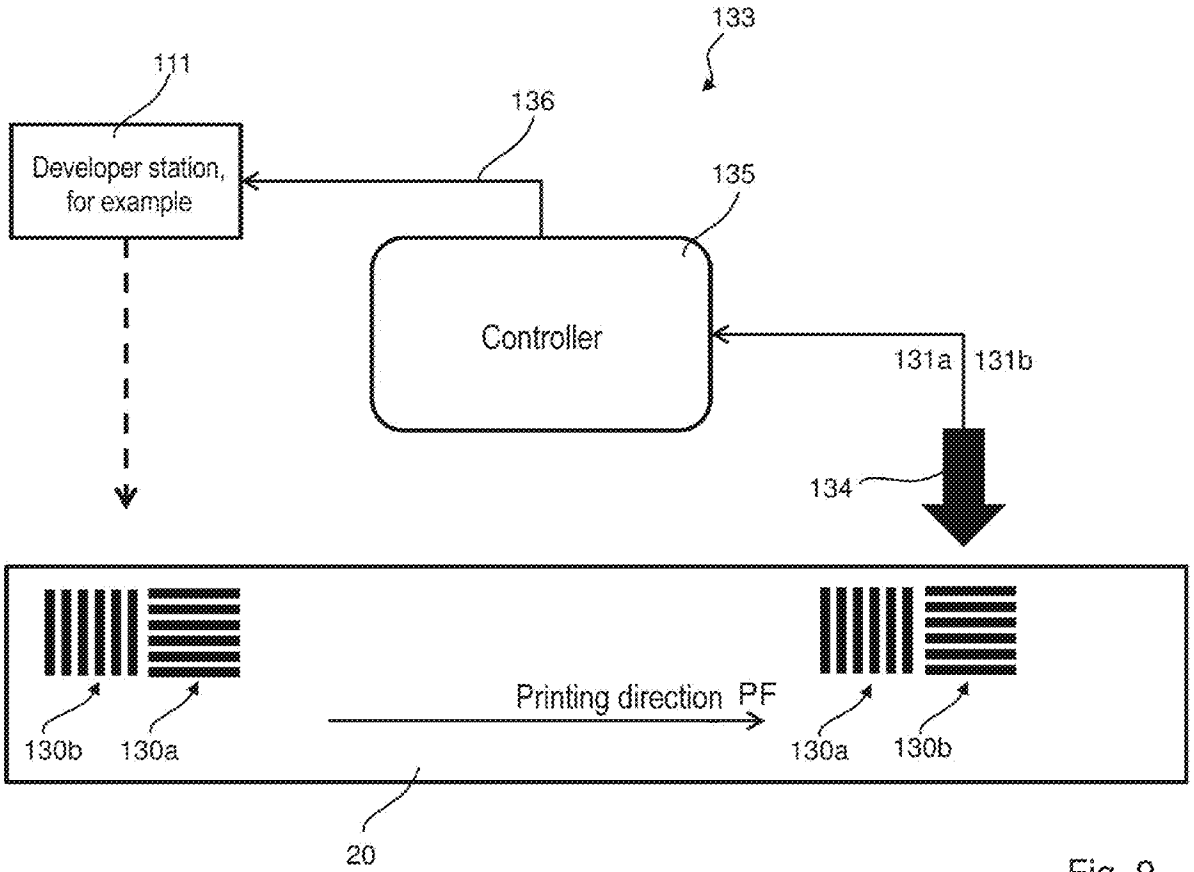
FIG. 9 illustrates a control loop for the adjustment of the amount of carrier fluid in the print image and at the unprinted locations on the recording medium.

If the amount of carrier fluid is optimally adjusted in the printing process, the two control markings 130*a*, 130*b* that are printed in series onto the recording medium 20 supply a constant ratio of the inking signals 131*a*, 131*b* that are dependent on the inking of their lines. Given ideal setting of all printing parameters, the two inking signals 131*a*, 131*b* are nearly identical. If the amount of carrier fluid increases in the printing process, the magnitude of the inking signal 131*a* (dependent on the lines of the first control marking 130*a*) also increases in comparison to the magnitude of the inking signal 131*b* (dependent on the lines of the second control marking 130*b*). In contrast to this, the inking signal 131*b* barely changes since the second control marking 130*b* at most homogenizes the layer thickness of the lines. The deviation of the ratio of the two inking signals 131*a*, 131*b* from the values given an ideal print setting is a measure of the deviation of the amount of carrier fluid from a predetermined nominal amount. This ratio may therefore be used as an adjustment signal 136 or control loop input variable for a control loop 133 (FIG. 9).

FIG. 3 shows the control markings 130*a*, 130*b* given use of a small amount of carrier fluid. FIG. 3*a* thereby shows the first control marking 130*a* and FIG. 3*b* shows the second control marking 130*b* for this case. The two control markings 130*a*, 130*b* have similar shapes whose inking signals 131*a*, 131*b* (derived from the shape of the lines 132) are therefore barely differentiable.

FIG. 4 shows the case in which a large amount of carrier fluid is used upon printing. FIG. 4*a* shows the first control marking 130*a* with a line pattern with lines 132 aligned transverse to the printing direction PF; FIG. 4*b* shows the second control marking 130*b* with a line pattern with lines 132 aligned in the printing direction PR The two control markings 130*a*, 130*b* differ significantly in the shape of their lines 132, and therefore in the dimension of their inking; their inking signals 131*a*, 131*b*, derived from the shape, thus likewise differ significantly. The line pattern of the first control marking 130*a* of FIG. 4*a* shows smeared lines; in contrast to this, the line pattern of the second control marking 130*b* of FIG. 4*b* has an unsmeared shape.

A comparison of FIGS. 3 and 4 clearly shows that the line pattern of the first control marking 130*a* of FIG. 3*a* and FIG. 4*a* clearly differ in the shape of the inking, whereas this is not the case in the line patterns of the second control marking 130*b* according to FIG. 3*b* and FIG. 4*b*. The control markings 130 of FIGS. 3 and 4 may thus be used in order to derive a control variable for regulation of the amount of carrier fluid from the comparison of their line patterns aligned transverse to the printing direction PF or, respectively, in the printing direction PF.

Figure 5:
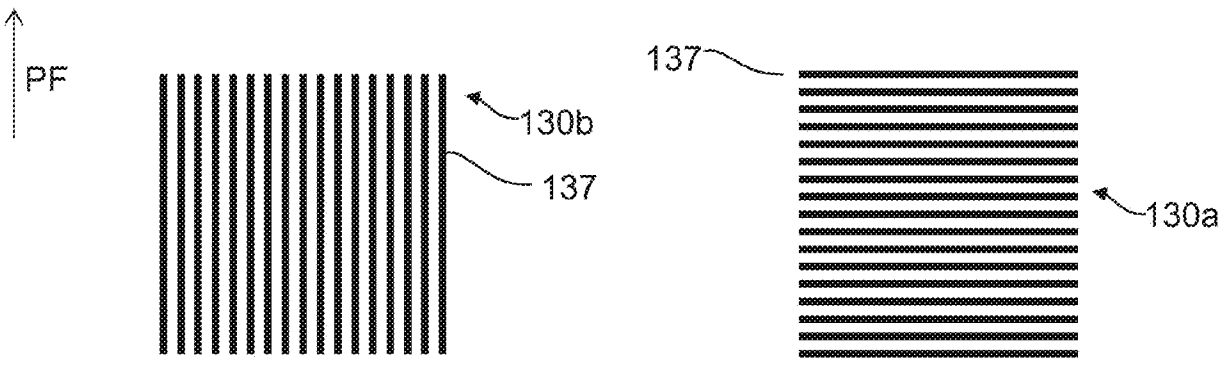
FIGS. 5 through 8 show additional examples of control markings.

FIGS. 5 through 8 show additional examples of control markings 130*a*, 130*b* with structures suitable for an exemplary embodiment of the invention:

FIG. 5 shows control markings 130 that are comprised exclusively of narrow lines 137. In FIG. 5*b*, the lines 137 are aligned in the printing direction PF (control marking 130*b*); in FIG. 5*a*, the lines 137 are aligned transversal to the printing direction PF (control marking 130*a*).

Figure 6:
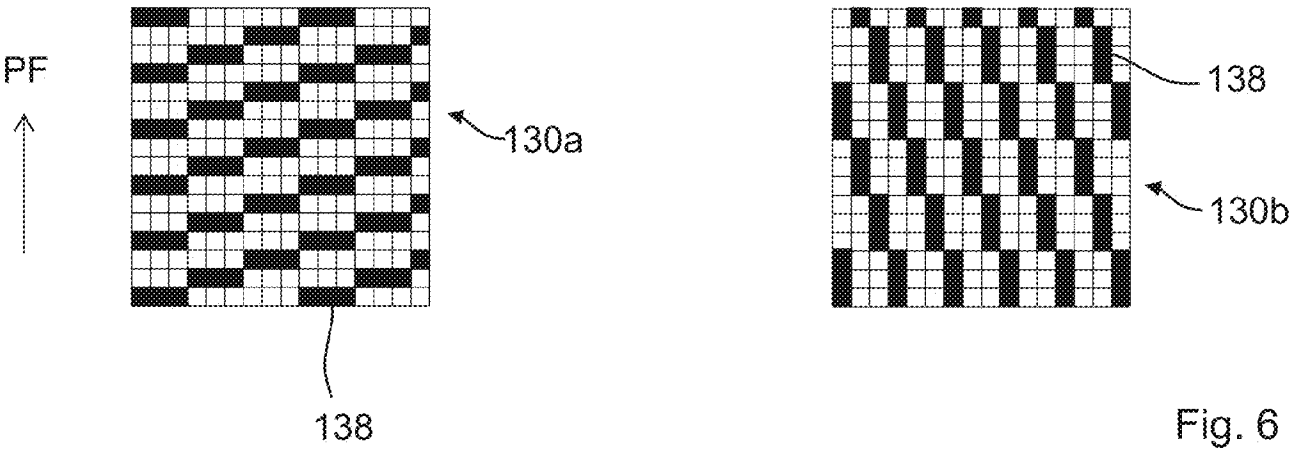

FIG. 6 shows control markings 130 that are comprised of interrupted grid lines 138 of different preferential direction; in the control marking 130*a*, the grid lines 138 are aligned transverse to the printing direction PF, in the control marking 130*b* the grid lines 138 are aligned in the printing direction PF.

Figure 7:
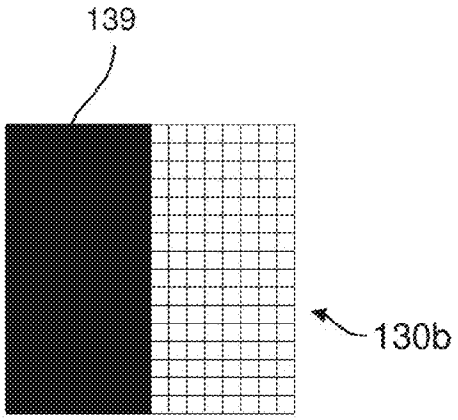
Figure 7:
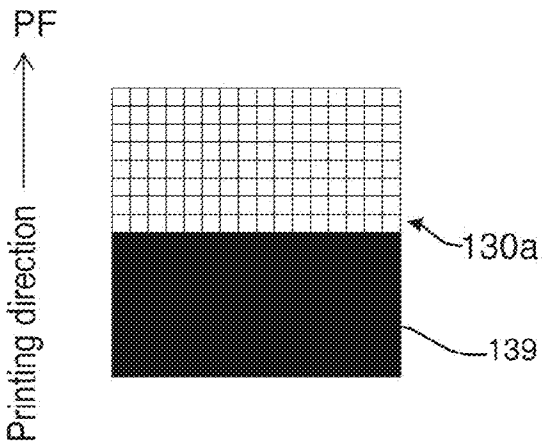

FIG. 7 shows control markings 130 that are executed as hemifields 139. The hemifield 139 of the control marking 130*a* is thereby transverse to the printing direction PF; the hemifield 139 of the second control marking 130*b* is aligned in the printing direction PF.

Figure 8:
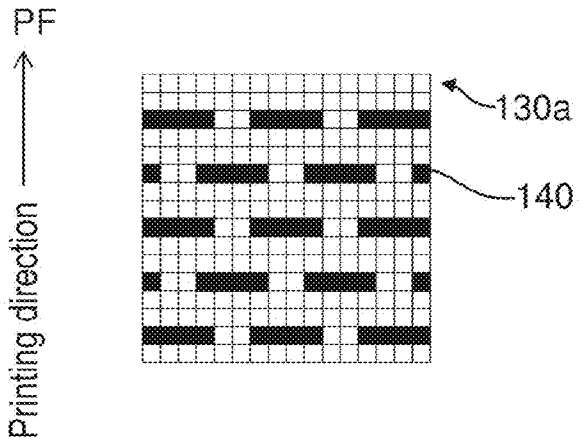

FIG. 8 shows control markings 130 in which the grid lines 140 are executed with interruptions. The grid lines 140 of the control marking 130*a* are aligned transverse to the printing direction PF; and those of the control marking 130*b* are aligned in the printing direction PF.

For example, in FIG. 9 the first inking signal 131*a* may be determined from the inking of the line pattern of the first control marking 130*a*; this first inking signal 131*a* may be compared with a predetermined nominal value of the inking signal; and, depending on the difference, the adjustment signal 136 may be derived with which the amount of carrier fluid may be modified so that the measured inking signal 131*a* approaches its nominal value.

It is advantageous if the two adjustment signals 131*a* and 131*b* are used to regulate the amount of carrier fluid. The ratio of the inking signals 131*a* to 131*b* may then be calculated as a real ratio, and this real ratio may then be compared with a predetermined nominal value, wherein given a deviation the amount of carrier fluid is modified so that the nominal value is approached. The ratio of the inking signals 131*a*, 131*b*, in that this achieves approximately a value of one, may then appropriately be used as a nominal value. The ratio is thereby also dependent on the type of recording medium 20 (paper, for example) and the inking of the line pattern.

To determine the inking signals 131*a*, 131*b*, for example, the following method may be used:

High-resolution greyscale images of the control markings 130*a*, 130*b* may be taken with an in-line camera; for example, the resolution may be approximately 5 μm per image point or pixel given images printed in the raster method. The images are subsequently converted into black-and-white images, wherein the threshold for the conversion of a pixel into black or white is to be established beforehand based on the characteristics of the camera for a series of recording medium substrates. Given a color camera (RGB), the channel that has the greatest signal for the respective color is preferably used and converted into greyscales. From the black-and-white images, the areal proportion of the black pixel is respectively determined as an inking signal 131. The adjustment value 136 that may be used to control the amount of carrier fluid in the liquid developer may be derived from the ratio of the areal proportions of the black pixels of the line pattern of the two control markings 130*a*, 130*b*.

If a digital printer 10 with a plurality of print groups 11, 12 is used—for example in color printing—it is appropriate that all print groups 11, 12 print control markings 130*a*, 130*b*. The control markings 130 may then be evaluated immediately after each print group, or all control markings 130 may be measured after the last print group, or in the print groups the control markings 130 printed by the preceding print groups are evaluated. Tests in a printer 10 with a plurality of print groups 11, 12 have yielded that the black proportion shift increases from print group 11, 12 to print group 11, 12.

Given a printer with a plurality of print groups 11, 12, according to the exemplary embodiment it may also be determined what proportion of the black proportion shift a print group 11, 12 has; for example, it may thereby be determined whether the deviations of the amount of carrier fluid that are observed in a color are caused by the tested print group 11, 12 or upstream print groups 11, 12. A more targeted regulation of the amount of carrier fluid at the individual print groups 11, 12 is thereby possible.

The two control markings 130 may additionally be used as a color marking for online regulation of the inking (raster inking) or for online regulation of the detail quality of the print image (line sharpness, single point imaging).

The adjustment of the amount of carrier fluid may be implemented with the aid of the dosing roller 115 shown in FIG. 2 as a doser. For example, the amount of carrier fluid on the developer roller 111 may be modified by increasing the force with which the dosing roller 115 presses on the developer roller 111. The amount of carrier fluid in the liquid developer may likewise be modified in that the surface velocity of the dosing roller 115 is modified while maintaining the surface velocity of the developer roller 111. A reduction roller that may remove the carrier fluid from the transfer roller 121 may be arranged as an additional doser at the transfer roller 121 of the transfer station 120. Furthermore, the print velocity of the print group 11, 12 may be regulated as a doser.

Instead of the greyscale value recording method illustrated above, the integrally measured color (for example CIELAB values) or the optical density of the control markings 130 may also be determined as an inking signal 131. The severity of the raster blurring, and therefore the required correction of the amount of carrier fluid, may be concluded via the evaluation of the color differences between the control markings 130. Corresponding correction curves can either be centrally determined and stored or be specifically determined via targeted variations of the printing conditions. An example of a control loop 133 for regulation of the amount of carrier fluid in the liquid developer results from FIG. 9. The control markings 130*a*, 130*b* are regularly printed on the recording medium 20, which is transported in the direction of the arrow PF. The order of the control markings 130*a*, 130*b* on the recording medium 20 is arbitrary. The control markings 130*a*, 130*b* are scanned with a measurer 134; the scan values for the control markings 130*a*, 130*b* are supplied as measurement signals 131*a*, 131*b* (inking signals 131*a*, 131*b*) to a controller 135. In the controller 135, the measurement signals 131*a*, 131*b* are evaluated and an adjustment signal 136 is generated that represents for the controller a measure of the amount of carrier fluid in the liquid developer. This adjustment signal 136 is supplied to the respective print group 11, 12; for example, it is used to control the doser (thus the controller of for example, the contact pressure force of the dosing roller 115 on the developer roller 111) such that the amount of carrier fluid in the liquid developer that is set on the developer roller 111 leads to an amount of carrier fluid upon transfer of the toner images onto the recording medium 20 that is optimal for the quality of the print images on the recording medium 20.

REFERENCE LIST

10 digital printer
11, 11*a*-11*d* print group (front side)
12, 12*a*-12*d* print group (back side)
20 recording medium
20' print image (toner)
20" transport direction of the recording medium
21 roll (input)
22 take-off
23 conditioning group
24 turner
25 register
26 puller
27 take-up
28 roll (output)
30 fixer
40 climate-control
50 power supply
60 controller
70 fluid management
71 fluid control
72 reservoir
100 electrophotography station
101 photoconductor roller
102 erasure light
103 cleaner (photoconductor)
104 blade (photoconductor)
105 collection container (photoconductor)
105' arrow
106 charger (corotron)
106' wire
106" shield
107 air supply channel (aeration)
108 air discharge channel (ventilation)
109 character generator
110 developer station
111 developer roller
112 storage chamber
112' fluid infeed
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge
120 transfer station
121 transfer roller

122 cleaner (wet chamber)
123 cleaning brush (wet chamber)
123' cleaning fluid infeed
124 cleaning roller (wet chamber)
124' cleaning fluid discharge
125 conditioner (retention plate)
126 counter-pressure roller
127 cleaner (counter-pressure roller)
128 collection container (counter-pressure roller)
128' fluid discharge
129 charger (corotron at transfer roller)
130 control marking
131 inking signal
132 line
133 control loop
134 measurer
135 controller
136 adjustment signal
137 lines
138 grid lines
139 hemifield
140 lines Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to adjust print quality of print images in an electrophoretic digital printer with at least one print group, comprising the steps of:

generating with the print group with an electrophotography station of the print group charge images of the print images;

with a developer station, developing the charge images into toner images using liquid developer having carrier fluid and toner;

transfer-printing the toner images onto a recording medium in a transfer station;

with said print group generating on the recording medium a first control marking with elements of the first control marking being aligned transverse to a printing direction;

measuring a shape of the elements of the first control marking to generate a first measurement signal; and comparing the first measurement signal with a predetermined nominal value, and given a difference between the first measurement signal and the predetermined nominal value generating an adjustment signal via which an amount of the carrier fluid in the liquid developer is modified so that the first measurement signal approaches the predetermined nominal value.

2. The method according to claim 1 in which:

the developer station has a rotating developer roller that supplies the liquid developer to the electrophotography station to develop the charge images;

a doser resting on the developer roller and via which a proportion of carrier fluid on the developer roller is adjusted before the liquid developer is supplied to the electrophotography station; and the doser adjusts the proportion of carrier fluid in the liquid developer on the developer roller depending on the adjustment signal.

3. The method according to claim 2 in which a dosing roller is used as said doser, a contact pressure of which on the developer roller or whose surface velocity is modified in comparison to the developer roller depending on the adjustment signal.

4. The method according to claim 1 in which:

the transfer station has a transfer roller that transfer-prints the toner images onto the recording medium; and a reduction roller running on the transfer roller is used as a doser, a contact pressure of the doser on the transfer roller or whose surface velocity is modified in comparison to the transfer roller, depending on the adjustment signal.

5. The method according to claim 1 in which a print speed is changed depending on the adjustment signal to adjust a proportion of carrier fluid in the liquid developer.

6. A method to adjust print quality of print images in an electrophoretic digital printer with at least one print group, comprising the steps of:

generating with the print group with an electrophotographic station of the print group charge images of the print images;

with a developer station, developing the charge images into toner images using liquid developer having carrier fluid and toner;

transfer-printing the toner images onto a recording medium in a transfer station;

with said print group generating on the recording medium a first control marking with elements of the first control marking being aligned transverse to a printing direction;

measuring a shape of the elements of the first control marking to generate a first measurement signal;

also with said print group generating on the recording medium in addition to the first control marking a second control marking with elements of the second control marking being aligned in the printing direction;

measuring a shape of the elements of the second control marking to generate a second measurement signal;

calculating a ratio of the first and second measurement signals of the first and second control markings, and comparing said ratio with an additional nominal value; and given a difference between the ratio and the additional nominal value, generating an adjustment signal via which an amount of the carrier fluid in the liquid developer is varied so that the ratio approaches the additional nominal value.

7. The method according to claim 6 in which the additional nominal value is present when the ratio of the measurement signals of the control markings is approximately one.

8. The method according to claim 6 in which the first control marking has elements with edges aligned transverse to the printing direction.

9. The method according to claim 8 in which the second control marking has a same structure as the first control marking, and wherein the elements have edges aligned in the printing direction.

10. The method according to claim 6 in which:

an areal proportion of inking in the first control marking is measured as the first measurement signal; and an areal proportion of inking in the second control marking is measured as the second measurement signal.

11. The method according to claim 10 in which:

a measurer with a camera is arranged adjacent to the recording medium and which scans the first and second control markings to generate the first and second measurement signals;

the first and second measurement signals are converted into black-and-white images;

the first and second measurement signals are tested per pixel, and if a pixel exceeds a predetermined threshold that pixel is assessed as a black pixel, and otherwise it is assessed as a white pixel; and an areal proportion of the black pixels is determined, and said proportion is used in the determination of the ratio of the first and second measurement signals.

12. The method according to claim 6 in which the first and second measurement signals are generated via evaluation of an optical density of the first and second control markings.

13. The method according to claim 6 in which the first and second measurement signals are generated via evaluation of CIELAB values of integrally measured colors of the first and second control markings.

14. The method according to claim 6 in which:

the developer station has a rotating developer roller that supplies the liquid developer to the electrophotography station to develop the charge images;

a doser rests on the developer roller via which a proportion of carrier fluid on the developer roller is adjusted before the liquid developer is supplied to the electrophotography station; and the doser adjusts the proportion of carrier fluid in the liquid developer on the developer roller depending on the adjustment signal.

15. The method according to claim 14 in which a dosing roller is used as said doser, a contact pressure of which on the developer roller or whose surface velocity is modified in comparison to the developer roller depending on the adjustment signal.

16. The method according to claim 6 in which:

the transfer station has a transfer roller that transfer-prints the toner images onto the recording medium; and a reduction roller running on the transfer roller is used as a doser, a contact pressure of the reduction roller on the transfer roller or whose surface velocity is modified in comparison to the transfer roller depending on the adjustment signal.

17. The method according to claim 6 in which a print speed is changed depending on the adjustment signal to adjust a proportion of carrier fluid in the liquid developer.

18. The method according to claim 6 in which:

the digital printer has a plurality of print groups;

at least one print group prints the first and second control markings on the recording media;

the first and second measurement signals are determined for the first and second control markings of said print group; and the ratio of the first and second measurement signals is respectively calculated to determine the adjustment signal.

19. The method according to claim 18 in which the adjustment signal determined in the print group is used to control an amount of carrier fluid of the print groups upstream of the print group.

20. The method according to claim 6 in which:

the digital printer has a plurality of print groups, in which each print group respectively prints first and second control markings onto the recording medium; and for the first and second control markings printed by the print groups, the first and second measurement signals are determined after each print group or the first and second measurement signals for all preceding print groups are determined after a selectable print group, and the ratio of the first and second measurement signals is calculated to determine the adjustment signal.

* * * * *